US005759064A

United States Patent [19]

Sugiyama

[11] Patent Number: 5,759,064

[45] Date of Patent: Jun. 2, 1998

[54] WATERPROOF LAMP SOCKET STRUCTURE

[75] Inventor: Norio Sugiyama, Shizuoka, Japan

[73] Assignee: Yazaki Corporation, Tokyo, Japan

[21] Appl. No.: 679,003

[22] Filed: Jul. 12, 1996

[30] Foreign Application Priority Data

Jul. 28, 1995 [JP] Japan ..... 7-193515

[51] Int. Cl.[6] ..... H01R 13/73

[52] U.S. Cl. ..... 439/548

[58] Field of Search ..... 439/548, 546, 439/558, 699

[56] References Cited

U.S. PATENT DOCUMENTS 4,957,455 9/1990 Horiuchi et al. ..... 439/548

FOREIGN PATENT DOCUMENTS 5-72076 9/1993 Japan .

*Primary Examiner*—Khiem Nguyen
*Assistant Examiner*—Eugene G. Byrd
*Attorney, Agent, or Firm*—Morgan, Lewis & Bockius LLP

[57] ABSTRACT

A waterproof lamp socket structure includes a bayonet lamp socket structure having lock engagement hooks and a flange, an attachment panel, which the lamp socket is fastened to and which has a cylindrical rib, and an annular gasket supported between the lock engagement hooks and the flange by the attachment panel. The annular gasket is provided with an outer sealing engagement rim forming an airtight engagement with an inner cylindrical surface of the cylindrical rib.

6 Claims, 3 Drawing Sheets

WATERPROOF LAMP SOCKET STRUCTURE

BACKGROUND OF THE INVENTION

1. Field of the Invention

The present invention relates to a waterproof lamp socket structure, and particularly relates to an improvement in the waterproof lamp socket structure to utilize the gasket mounted between the lamp socket of a bayonet structure, the construction of which allows free attachment to and detachment from the lamp body attachment panel, and the attachment panel.

2. Background

A conventional waterproof lamp socket structure of this type is published in Unexamined Japanese Utility Model No. Hei. 5-72076. As shown in FIG. 4, a lamp socket 1 has a bayonet structure in which four lock engagement hooks 3 are provided at the front end of a cylindrical insertion-mount part 2 in the insertion-mounting direction while a flange is provided at the rear end of such insertion-mount part 2. An attachment hole 6, which is slightly larger than such insertion-mount part 2, and hook escape parts 7 for allowing such lock engagement hooks 3 to go through are formed in a lamp body attachment panel 5, and the lamp socket 1 is attached by inserting the insertion-mount part 2 through the attachment hole 6 while the lock engagement hooks 3 and the hook escape parts 7 are positioned to match and then by revolving the lamp socket 1; thus the attachment panel 5 is locked while being supported by the flange 4 and the lock engagement hooks 3. The lamp socket 1 is attached to a gasket 8, which is formed of an elastic material such as rubber disposed to waterproof the clearance between the lamp socket 1 and the attachment panel 5.

That is, the insertion and revolution of the lamp socket 1 through the attachment panel 5 produces the waterproof sealing effect by the compression of the gasket 8 along the axial direction between the lock engagement hooks 3 and the flange 4 of the lamp socket 1 via the attachment panel 5. There is also produced a preventive force against detachment of the lamp socket, from the attachment panel through utilization of the rotational torque produced by revolving the lamp socket 1.

To produce a sufficient preventive force against detachment in this construction, it is necessary to establish a high rotational torque with respect to the lamp socket 1 so that there is established a high compressive force being applied to the gasket 8 the conventional construction suffers from the problem that the high compressive force established degrades the assembling efficiency of the lamp socket. If the compressive force applied to the gasket 8 is simply reduced for improvement of the assembling efficiency, the problem of a decrease in the waterproof sealing effect between the lamp socket 1 and the attachment panel 5 will arise.

SUMMARY OF THE INVENTION

In view of these circumstances, an object of the present invention is to provide a waterproof lamp socket structure which produces a sufficient waterproof sealing effect between the lamp body attachment panel and the lamp socket and effectuates an improvement in the efficiency of assembling the lamp socket onto the lamp body attachment panel.

The foregoing object of the present invention has been achieved by a waterproof lamp socket structure which includes a lamp socket including an insertion-mount part having a plurality of lock engagement hooks and a flange provided at the edge of the insertion-mount part. Furthermore there is an attachment panel including an attachment hole which allows the insertion-mount part of the lamp socket to pass through and prevents the flange from also passing through. Hook escape parts are also includes which allow the lock engagement hooks of the lamp socket to pass through, a cylindrical rib is provided and surrounds the attachment hole and the escape parts and is concentric with the attachment hole. An annular gasket is also included and is supported between the lock engagement hooks and the flange via the attachment panel when the lamp socket is attached to the attachment panel wherein the attachment panel includes an outer sealing engagement rim matching the inner cylindrical surface of the cylindrical rib.

According to the above-described construction, a sufficient waterproof sealing is effectuated between the attachment panel and the lamp socket resulting in an improvement in the efficiency of assembling the lamp socket onto the attachment panel is achieved by the provision of both the cylindrical rib on the lamp body attachment panel and the annular gasket which includes the outer sealing engagement rim forming an airtight engagement with the inner cylindrical surface of the cylindrical rib and which is supported between the lock engagement hooks and the flange via the attachment panel.

DETAILED DESCRIPTION OF THE PREFERRED EMBODIMENTS

Figure 1:
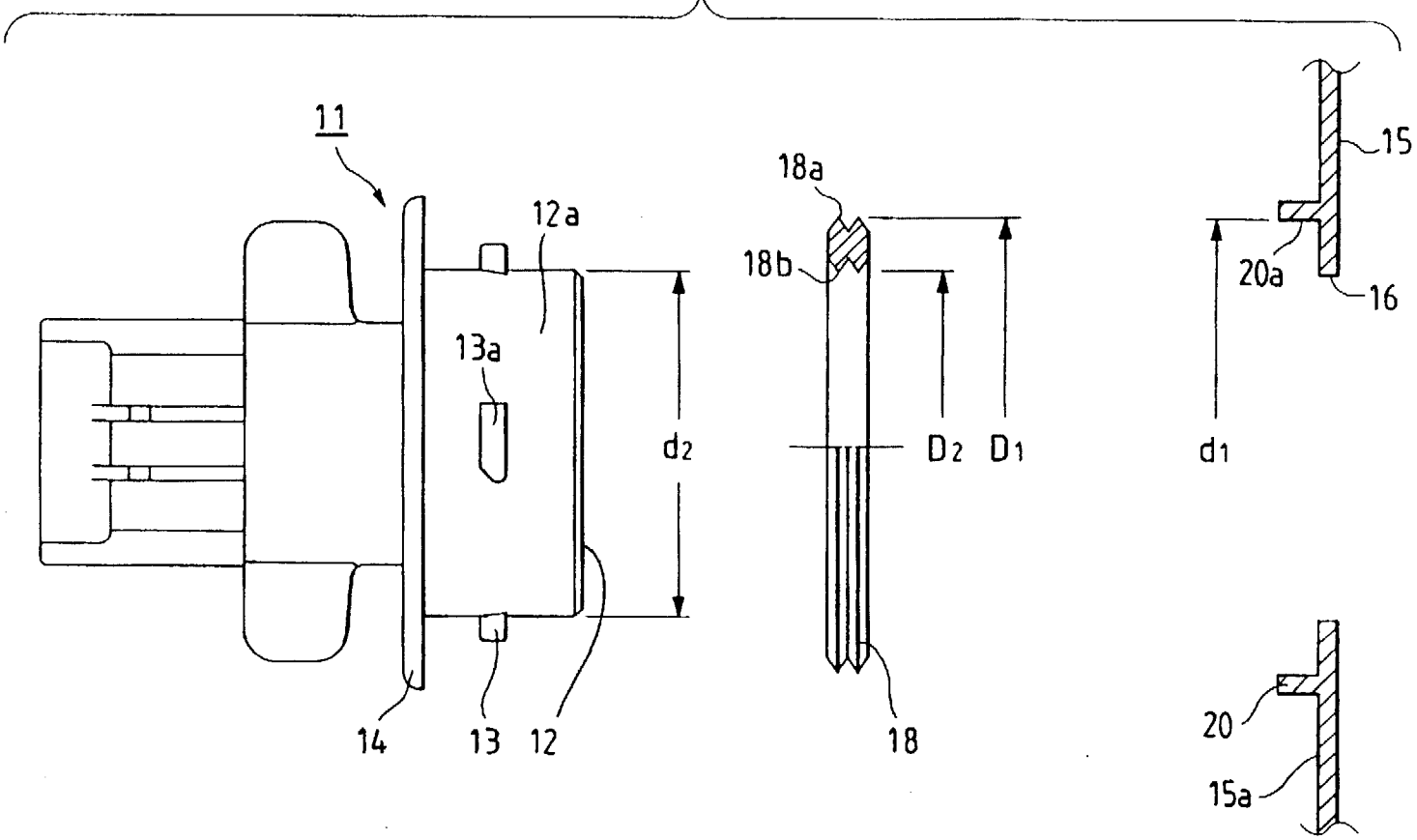
FIG. 1 is a disassembled lateral side view of the waterproof lamp socket structure of an embodiment related to the present invention, in which the upper part of the attachment panel is depicted in a sectional view while the lower part is depicted in a lateral side view.

A detailed description will now be made with reference to FIGS. 1 though 3, of the following aspect of an embodiment of the waterproof lamp socket structure according to the present invention. FIG. 1 is a disassembled lateral side view of the waterproof lamp socket structure, FIG. 2 is a plan view of the attachment panel 15 and FIG. 3 is an assembled lateral side view of the waterproof lamp socket structure.

As shown in FIG. 1, the lamp socket 11 includes an insertion-mount part 12, in which four lock engagement hooks 13 are located at intervals divided equally in a circumferential direction, and an annular flange 14, which is provided at a rear end of the insertion-mount part 12. One of the four lock engagement hooks 13 is a guiding lock engagement hook **13*a* which is wider than the other lock engagement hooks so as to function as a guide for positioning when the lamp socket 11 is inserted into the attachment panel 15**.

Figure 2:
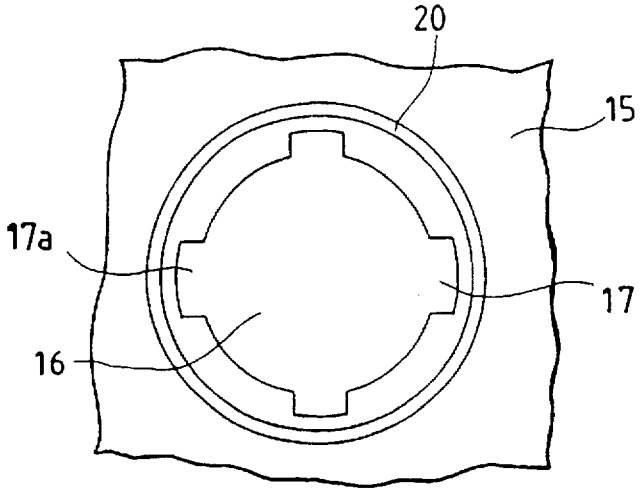
FIG. 2 is a plan view of the attachment panel embodiment of FIG. 1
Figure 3:
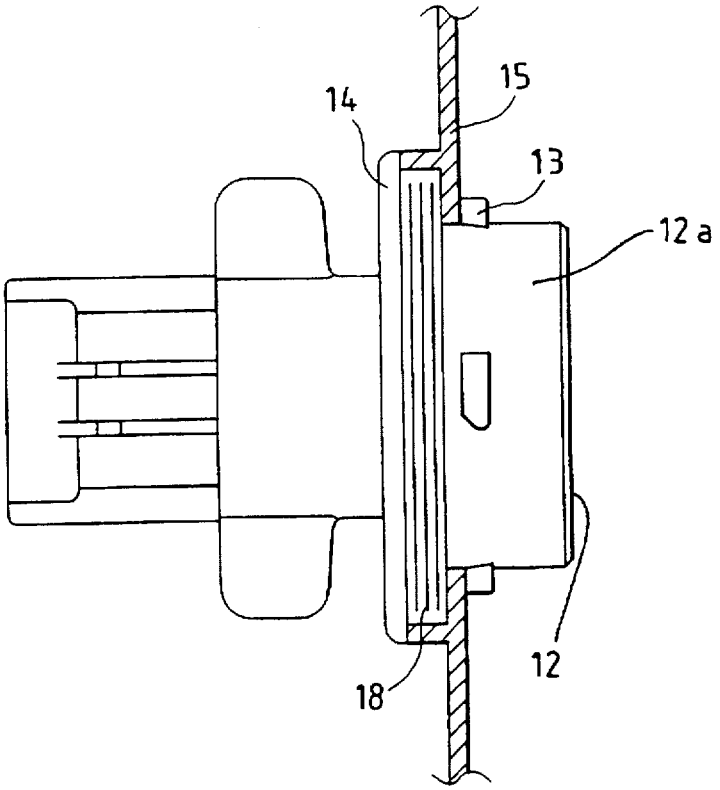
FIG. 3 is a lateral side view of the attachment panel embodiment of FIG. 1.
Figure 4:
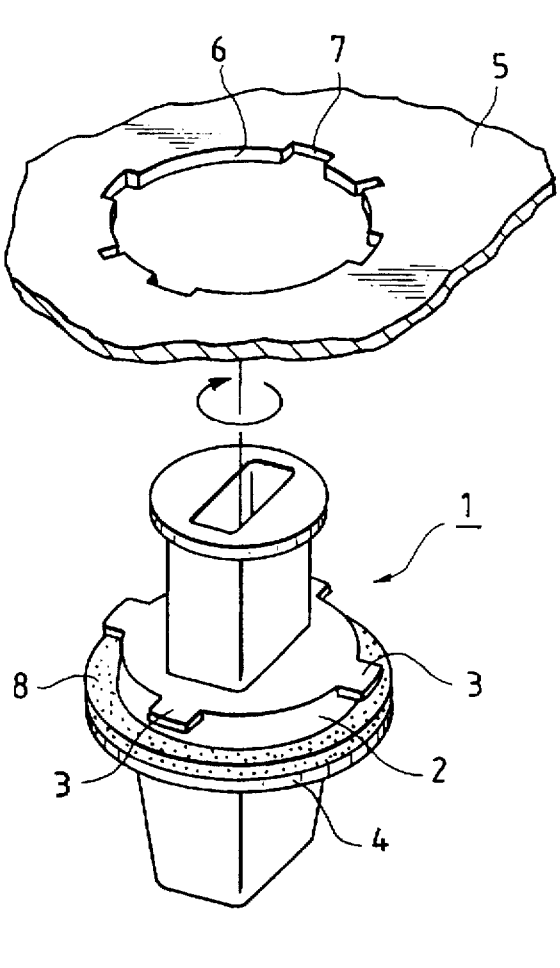
FIG. 4 PRIOR ART
FIG. 4 is a perspective view of a conventional waterproof lamp socket structure.

As shown in FIGS. 1 through 2, an attachment hole 16 for attaching the lamp socket 11 is provided in the attachment panel 15 and four hook escape parts 17 are also provided at positions which correspond respectively to the lock engagement hooks 13 so as to allow the lock engagement hooks 13 of the lamp socket 11 to pass through. One of the four hook escape parts 17 is a guiding lock engagement hook escape part 17*a* which is wider than the other hook escape parts 17 so as to allow the guiding lock engagement hook 13*a* to pass through. That is, since the guiding lock engagement hook 13*a* is wider than the other lock engagement hooks 13, the guiding lock engagement hook 13*a* is allowed to pass through only the guiding lock engagement hook escape part 17*a* when the lamp socket is inserted into the attachment panel 15. There is only one position obtained through matching lock engagement hooks 13 and lock engagement locks escape parts 17 with each other, from which the lamp socket 11 is capable of being attached to the attachment panel 15.

As shown in FIGS. 1 and 2, a cylindrical rib 20 is provided around the attachment hole 16 and the hook escape parts 17 in the attachment panel 15 so as to be concentric with the attachment hole 16 and parallel to the axial centerline of the attachment hole 16 and so as to protrude from the flat surface 15*a* of the attachment panel 15.

As shown in FIGS. 1 and 3, when the lamp socket 11 is assembled onto the attachment panel 15, an annular gasket 18 which is made of an elastic material and supported between the lock engagement hooks 13 and the flange 14 via the attachment panel 15 is additionally provided. The annular gasket 18 includes an outer sealing engagement rim 18*a* which forms an airtight engagement with an inner cylindrical surface 20*a* of the cylindrical rib 20 and an inner sealing engagement rim 18*b* which forms an airtight engagement with the insertion-mount part 12. The airtight engagement of the outer sealing engagement rim 18*a* of the annular gasket 18 with the inner cylindrical surface 20*a*, at the time of assembling, when the annular gasket 18 is compressed in the radial direction between the inner cylindrical surface 20*a* of the cylindrical rib 20 and an outer cylindrical surface 12*a* of the insertion-mount part 12 produces the waterproof sealing effect between them. The gasket 18 is compressed along the axial centerline direction between the lock engagement hooks 13 and the flange 14 via the attachment panel 15. The compression of gasket 18 performed; assembling to hold the lamp socket 11 and prevent detachment from the attachment panel 15 which could be caused by vibration. The outer sealing engagement rim 18*a* and the inner sealing engagement rim 18*b* of the annular gasket 18 has a semiserrated section.

Outer diameter D1 of the outer sealing engagement rim 18*a* of the annular gasket 18, inner diameter D2 of the inner sealing engagement rim 18*b*, inner diameter d1 of the inner cylindrical surface 20*a* of the cylindrical rib 20 and outer diameter d2 of the insertion-mount part 12 are established so as to satisfy the following formula:

$$d2 \leqq D2 < D1 \leqq d1$$

As described above, the production of sufficient waterproofing, caused by compression of the annular gasket 18 in the radial direction a allows waterproofing to be effectuated by compression of the annular gasket 18 along the axial centerline of the insertion mount 12 to be disregarded. The compression, along the axial centerline of the insertion mount, can be reduced to a level just strong enough to hold the lamp socket 11 so as not to be detached from the attachment panel 15 by any vibration.

The compressive force applied on the annular gasket 18 is adjustable by modifying the inner diameter of the cylindrical rib 20 attached to the attachment panel 15 and the outer diameter of the cylindrical surface 12*a*, the insertion-mount part 12 of the lamp socket 11 or by modifying the outer and inner diameters of the annular gasket 18.

The assembling operation of the above embodiment will not be described in detail.

First, the annular gasket 18 is elastically deformed to ride over the lock engagement part 13 and the annular gasket 18 is attached to the insertion-mount part 12 between the lock engagement part 13 and the flange 14 of the lamp socket 11. The positions of the guiding lock engagement hooks 13*a* of the lamp socket 11, where the annular gasket 18 is attached, and the guiding lock engagement hook escape parts 17*a* in the attachment panel 15, are matched and the insertion-mount part 12 and the lock engagement part 13 are inserted into the attachment hole 16 and the hook escape parts 17. The lamp socket 11 is then revolved while the annular gasket 18 is compressed and held between the lock engagement parts 13 and the flange 14 via the attachment panel 15 to complete the assembling operation.

According to the waterproof lamp socket structure of the present invention as described above, the provision of the cylindrical rib 20 on the lamp body attachment panel 15 and the provision of the annular gasket 18, which has the outer sealing engagement rim 18*a* forming an airtight engagement with the inner cylindrical surface 20*a* of the cylindrical rib 20. This produces sufficient waterproof sealing by compression in the radial direction of the annular gasket 18 supported between the cylindrical rib 20 on the attachment panel 15 and the outer cylindrical surface of the insertion-mount part 12. As a result, the compressive force, along the axial centerline direction, of the gasket 18 supported between the lock engagement hooks 13 and the flange 14 of the lamp socket 11 via the attachment panel 15 can be reduced to a level just strong enough to hold the lamp socket 11 so as not to be detached from the attachment panel 15, and thus effectuate improvement in the efficiency of assembling the lamp socket 11 onto the attachment panel 15.

What is claimed is:

1. A lamp socket, comprising:

an insertion-mount part having a plurality of lock engagement hooks;

a flange formed around an edge portion of said insertion-mount part;

an attachment panel including an attachment hole allowing said insertion-mount part to pass therethrough and preventing said flange from passing therethrough, hook escape parts allowing said lock engagement hooks to pass therethrough, and a cylindrical rib formed so as to be concentric with said attachment hole and surrounding said attachment hole and said hook escape parts; and an annular gasket, said gasket being supported between said lock engagement hooks and said flange by said attachment panel when the lamp socket is attached to said attachment panel, wherein said annular gasket including an outer sealing engagement rim for engaging an inner cylindrical surface of said cylindrical rib.

2. The lamp socket of claim 1, wherein said annular gasket has an inner sealing engagement rim for engaging an outer cylindrical surface of said insertion-mount part.

3. The lamp socket of claim 2, wherein the inner sealing engagement rim has a semiserrated section.

4. The lamp socket of claim 2, wherein an outer diameter (D1) of the outer sealing engagement rim of said annular gasket, an inner diameter (D2) of the inner sealing engagement rim, an inner diameter (d1) of the inner cylindrical surface of said cylindrical rib and an outer diameter (d2) of said insertion-mount part are established so as to satisfy the following formula:

$$d2 \leqq D2 < D1 \leqq d1$$

5. The lamp socket of claim 1, wherein the outer sealing engagement rim has a semiserrated section.

6. The lamp socket of claim 1, wherein said annular gasket is made of an elastic material.

* * * * *